US005832683A

United States Patent [19]

Ito et al.

[11] Patent Number: 5,832,683

[45] Date of Patent: Nov. 10, 1998

[54] FRAMED ENCLOSURE

[75] Inventors: Tsutomu Ito, Marietta; Michael L. Turner, Dallas, both of Ga.; Toshimasa Kusunoki, Oozu, Japan

[73] Assignee: YKK Corporation of America, Marietta, Ga.

[21] Appl. No.: 811,171

[22] Filed: Mar. 4, 1997

[51] Int. Cl.[6] ..... E04B 5/00

[52] U.S. Cl. ..... 52/274; 52/93.1; 52/92.2

[58] Field of Search ..... 52/92.1, 92.2, 52/92.3, 93.1, 93.2, 276, 277, 278, 282.3, 653.1, 712, 655.1, 656.1, 656.2, 292, 293.3; 403/405.1, 407.1

[56] References Cited

U.S. PATENT DOCUMENTS

| | | | |
|---|---|---|---|
| 2,067,403 | 1/1937 | Lea | 52/92.1 X |
| 2,234,960 | 3/1941 | Buelow | 52/92.2 X |
| 2,330,819 | 10/1943 | Faure et al. | 52/92.2 |
| 2,835,325 | 5/1958 | Gilbert et al. . | |
| 2,837,153 | 6/1958 | Brown et al. . | |
| 3,143,165 | 8/1964 | Lewis et al. . | |
| 3,176,806 | 4/1965 | Ferrell . | |
| 3,182,766 | 5/1965 | Ferrell . | |
| 3,203,053 | 8/1965 | Lane et al. . | |
| 3,229,332 | 1/1966 | Koller . | |
| 3,309,120 | 3/1967 | Wada | 52/93.1 X |
| 3,696,857 | 10/1972 | Le Tarte . | |
| 4,055,923 | 11/1977 | Biebuyck . | |
| 4,084,360 | 4/1978 | Reckson . | |
| 4,188,764 | 2/1980 | Gode . | |
| 4,196,555 | 4/1980 | Henges, Jr. et al. . | |
| 4,201,019 | 5/1980 | Jones . | |
| 4,342,177 | 8/1982 | Smith . | |
| 4,535,577 | 8/1985 | Tenser et al. . | |
| 4,665,670 | 5/1987 | van den Burg . | |
| 4,683,686 | 8/1987 | Ozdemir . | |
| 4,697,393 | 10/1987 | Madray | 52/93.2 |
| 4,887,626 | 12/1989 | Dalo et al. . | |
| 5,224,306 | 7/1993 | Cramer . | |
| 5,224,307 | 7/1993 | Lukos . | |
| 5,402,612 | 4/1995 | diGirolamo et al. | 52/293.3 |
| 5,426,899 | 6/1995 | Jones . | |
| 5,600,924 | 2/1997 | Forsberg | 52/93.1 X |
| 5,660,005 | 8/1997 | Tacoma | 52/93.2 |

FOREIGN PATENT DOCUMENTS

| | | |
|---|---|---|
| 63-26543 | 7/1988 | Japan . |

*Primary Examiner*—Creighton Smith
*Attorney, Agent, or Firm*—Finnegan, Henderson, Farabow, Garrett & Dunner, L.L.P.

[57] ABSTRACT

A framed enclosure includes a roof unit and a wall unit attachable to both the roof unit and to a foundation. The roof unit may be attachable to a host structure via a gutter unit. The heads of fasteners connecting the wall unit to the foundation, the wall unit to adjacent wall units, the wall unit to the roof unit, the roof unit to adjacent roof units, and the roof unit to the gutter unit, are covered to prevent corrosion of the respective fasteners and improve the appearance of the enclosure. The connection between the roof unit and gutter unit is configured to prevent leakage of rainwater. A head member between the wall unit and the roof unit includes an upper portion defining a bridge between the head members of adjacent wall units.

34 Claims, 14 Drawing Sheets

FRAMED ENCLOSURE

BACKGROUND OF THE INVENTION

1. Field of the Invention

The present invention relates to a framed enclosure. More specifically, the present invention relates to a framed screened enclosure having no exposed metal fasteners, and additional features to prevent corrosion caused by exposure to the elements.

2. Description of the Related Art

Framed screened enclosures are well known. Such enclosures typically are used as swimming pool enclosures or patio enclosures, in order to exclude bugs and debris from the pool or patio, reduce maintenance on the pool or patio, and screen people in the pool or on the patio from the sun's rays.

A conventional framed enclosure attaches to a host structure, e.g., an eave or roof truss of a house. When attached to a host structure, the conventional framed enclosure includes a gutter unit attachable to the structure, one or more roof units or sections combined to form a roof, and one or more wall units or sections combined to form walls. The gutter unit, roof units, and wall units typically are made of metal (e.g., aluminum) beams and purlins, holding metal or plastic mesh screens. The conventional wall unit includes at least two vertical columns, at least one horizontal beam, and a sill unit. The sill unit bolts with metal fasteners to the patio, deck, or other foundation. The vertical columns include base plates that also bolt with metal fasteners to the patio, deck, or other foundation. The roof units typically include sloped or horizontal beams that bolt with metal fasteners to the vertical beams of adjacent wall units. A horizontal head member inserts between the wall unit and the roof unit. The beams of the roof units also bolt with metal fasteners to the gutter unit.

The conventional enclosure has several drawbacks. For example, the heads of the metal fasteners securing the wall units to the foundation, the wall units to the roof units, the roof units to the gutter units, the roof units to other roof units, and the wall units to other wall units, are exposed to the elements. Rain corrodes the heads of the fasteners, causing unsightly rust stains to spread on the connected beams and on the foundation, and weakening the connections between the various units.

Another problem is that when two adjacent wall units are connected, a gap is defined between the two adjacent horizontal head members. This gap is unsightly, and mars the appearance of the enclosure unless it is plugged with a separate piece.

Another problem is that rain water tends to leak through the junction between the roof beams and the gutter.

The rain water drips onto the patio or deck, resulting in mold and water stains on the patio or deck, and mildew buildup at the junction between the roof beam and the gutter unit.

Another problem is that excessive rain water rolling off the roof of the adjoining host structure spills out of the gutter, and splashes onto the patio or deck and the screen, again resulting in mold and water stains on the patio or deck, and also prematurely rotting or weathering the screen mesh.

SUMMARY OF THE INVENTION

The present invention corrects one or more shortcomings experienced by the conventional framed enclosures described above.

In accordance with the invention, a framed enclosure can either stand alone or attach to a host structure. A roof unit includes at least one roof beam. A wall unit includes at least one vertical wall column, the wall column being attachable to the roof beam at a first attachment point, and to a foundation at a second attachment point. The second attachment point includes a fastener connecting the wall column and the foundation, a head of the fastener being shielded from the elements.

In one embodiment, the roof column and the wall beam can be a single column, curved at the first attachment point, or two columns welded or brazed together at the first attachment point. Alternatively, the roof beam and wall column are separate beams, the first attachment point includes a recessed portion provided in an upper portion of the wall column, and the fastener is provided with its head resting in the recessed portion. The cover, having the same general configuration as the recessed portion, inserts into and closes the recessed portion, covering the head of the fastener.

Preferably, the second attachment point includes a flange extending from an outer edge of the wall column, engaging a flange extending from an outer edge of a wall column of an adjacent wall unit, defining a closed cavity therebetween that shields the second attachment point fastener. A generally U-shaped wall anchor is provided in the closed cavity, fastened via fasteners to each respective wall column and the foundation. A recessed portion is provided on an inner surface of a lower portion of the wall column, and a head of the fastener attaching the wall anchor to the wall column rests in the recessed portion. A cover, having the same general configuration as the recessed portion, inserts into and closes the recess, covering the head of the faster.

It is further preferable that a sill of the wall unit attach to the foundation. A recessed portion is provided in the sill, and a fastener inserts through the sill and into the foundation, with a head thereof resting in the recessed portion. A cover, having the same general configuration as the recessed portion, inserts into and closes the recessed portion, covering the head of the fastener.

The framed enclosure includes a head member insertable between the wall unit and the roof unit, the head member being an interconnectable two-part head member, including an upper member and a lower member, with the upper member having a length that is greater than a length of the lower member. When assembled, the longer upper member bridges over at least a portion of the vertical wall column and fills a gap that would otherwise be defined between the head members of adjacent wall units.

When attached to a host structure, the roof of the framed enclosure attaches to the host structure via a gutter unit. The gutter unit includes a generally U-shaped beam anchor attachable to a beam of the roof unit, and a watertight sealant is provided in a junction between the beam anchor and the roof beam. Fasteners connecting the roof beam to the beam anchor are provided in a recessed portion and covered with a cover. The gutter unit further includes a generally U-shaped channel having two sides. The first side attaches to the host structure and has a first length. The second side may be provided with a second length that is greater than the first length to act as a rain shield.

BRIEF DESCRIPTION OF THE DRAWINGS

The accompanying drawings, which are incorporated into and constitute a part of the specification, illustrate preferred embodiments of the invention. Together with the general description given above, and the detailed description of the preferred embodiments given below, the drawings serve to explain the principles of the invention.

DETAILED DESCRIPTION OF THE PREFERRED EMBODIMENTS

Reference will now be made in detail to the present preferred embodiments of the invention as broadly illustrated in the accompanying drawings.

Figure 1:
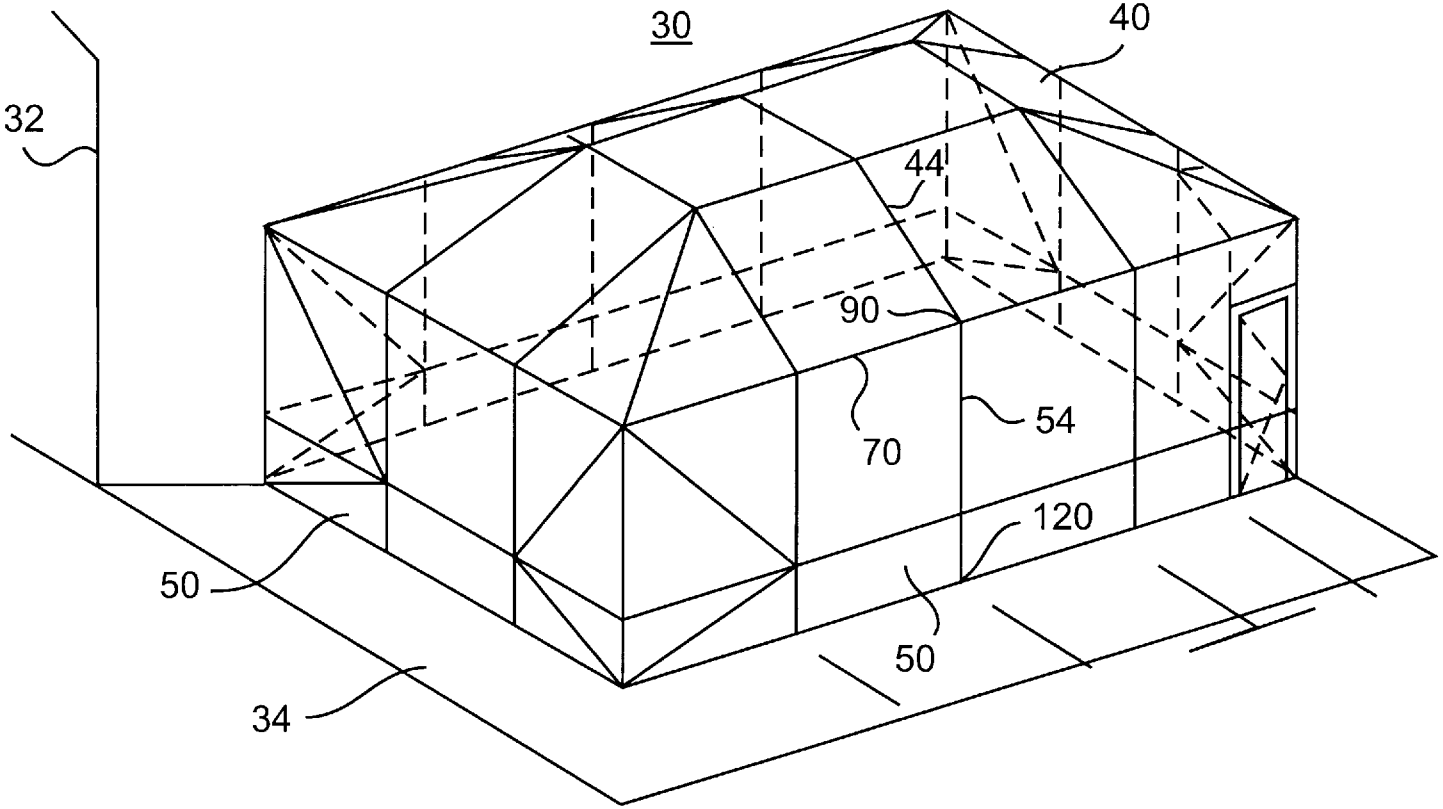
FIG. 1 is a perspective view of a framed enclosure in accordance with the invention, configured in a "Mansard" style.
Figure 2:
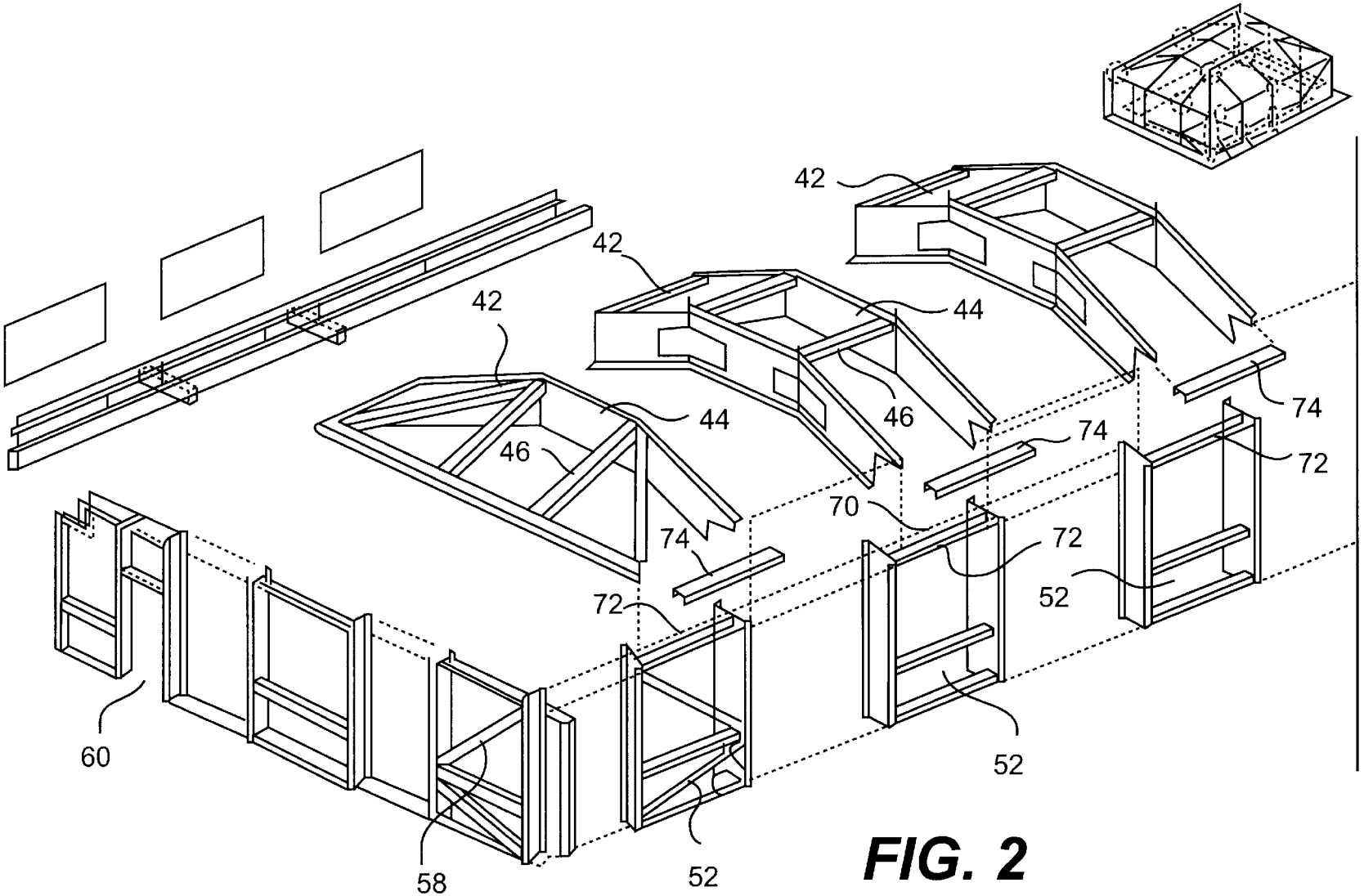
FIG. 2 is a disassembled part view of the embodiment of FIG. 1.
Figure 3:
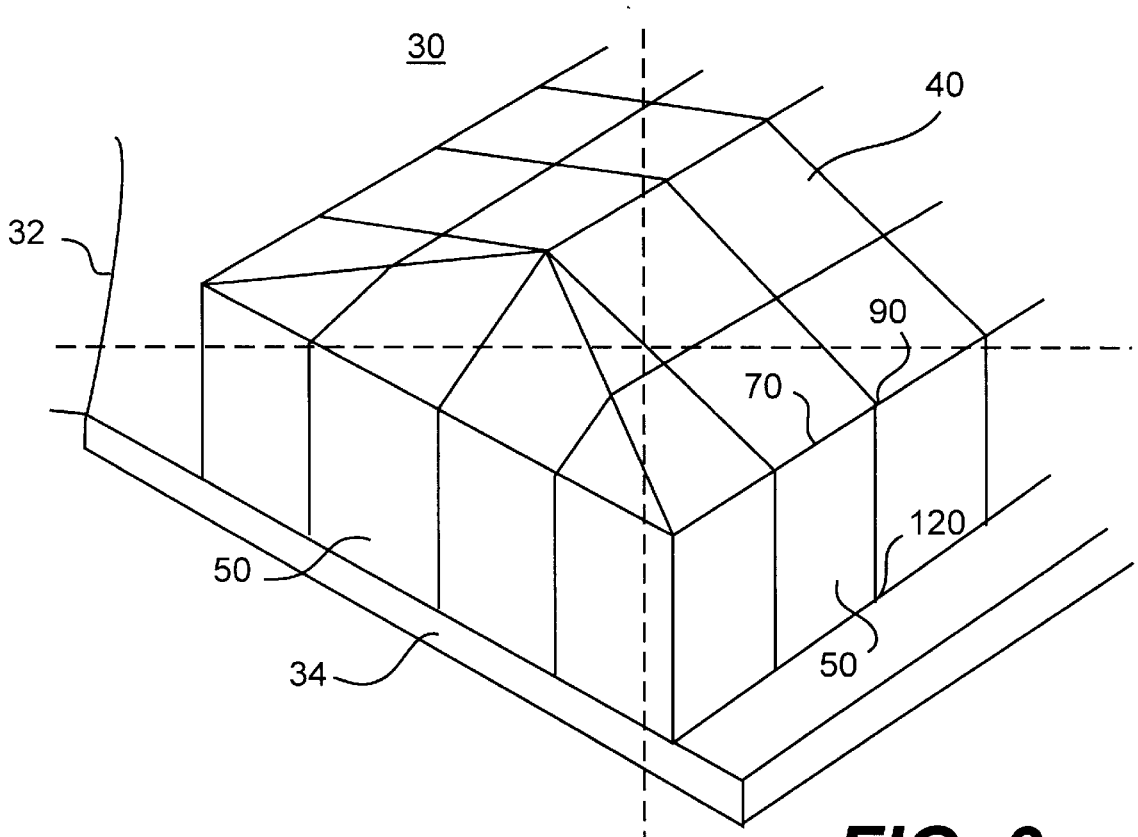
FIG. 3 is a partial perspective view of another framed enclosure in accordance with the invention, configured in a "Hip Gable" style.
Figure 4:
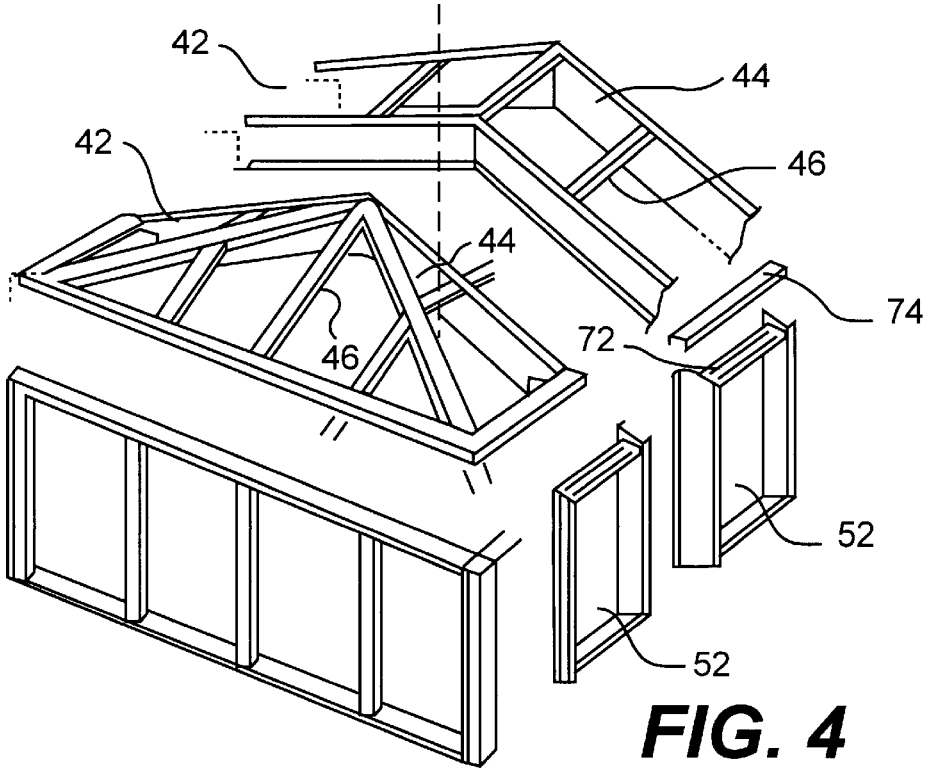
FIG. 4 is a disassembled part view of the embodiment of FIG. 3.
Figure 5:
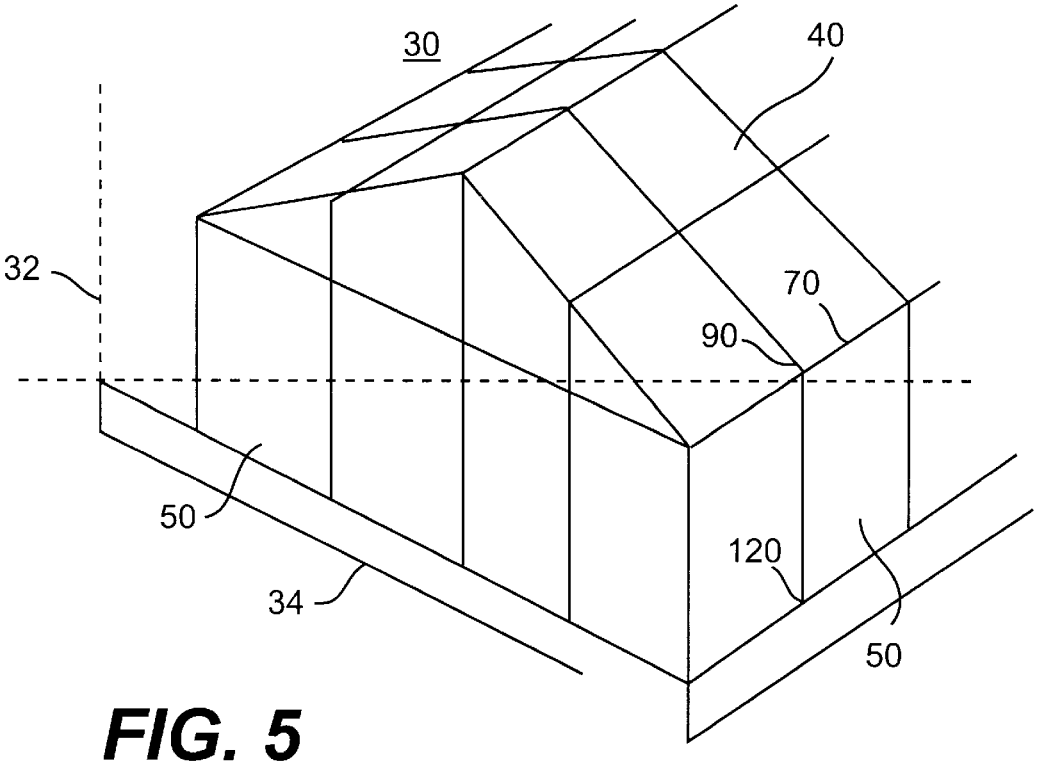
FIG. 5 is a partial perspective view of another framed enclosure in accordance with the invention, configured in a "Gable" style.
Figure 6:
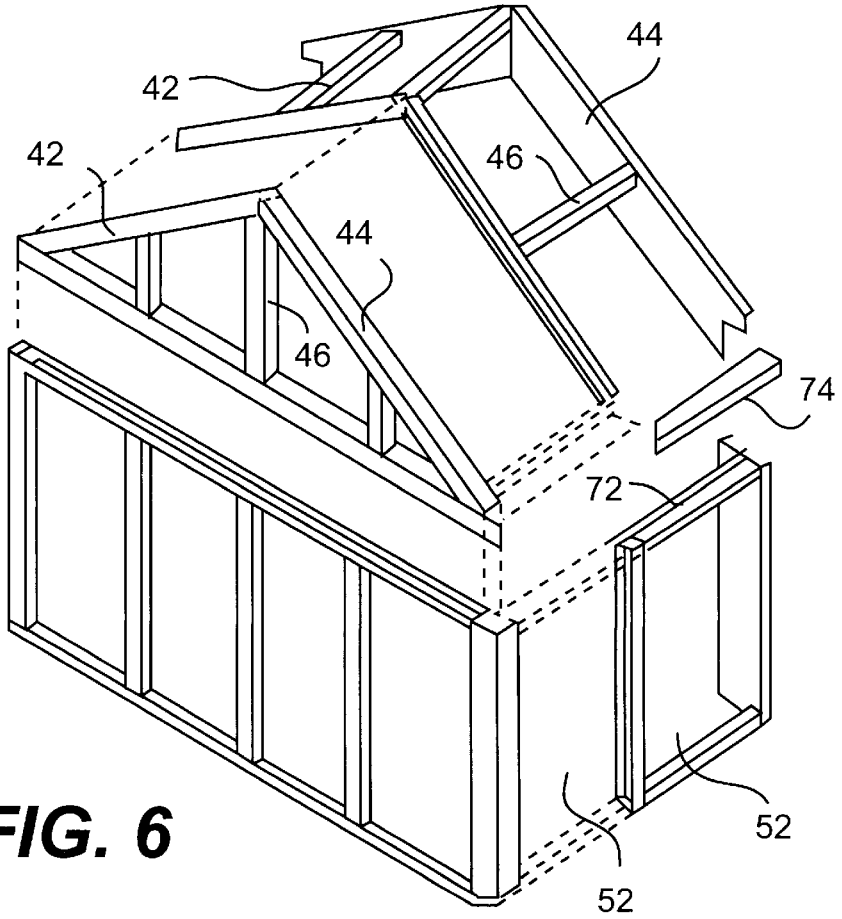
FIG. 6 is a disassembled part view of the embodiment of FIG. 5.
Figure 7:
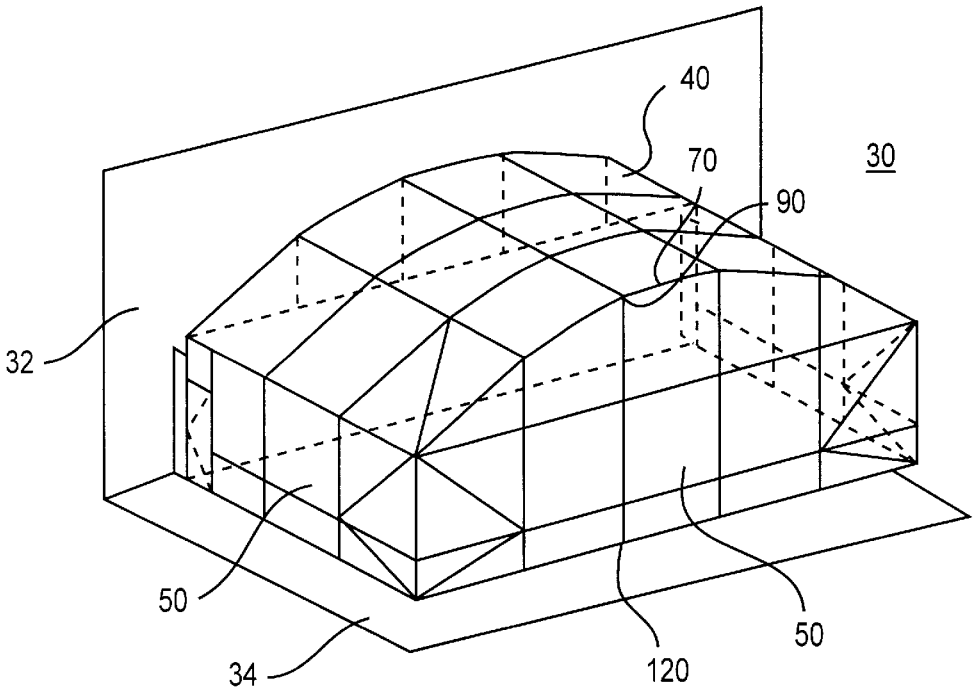
FIG. 7 is a partial perspective view of another framed enclosure in accordance with the invention, configured in a "Dome" style.
Figure 8:
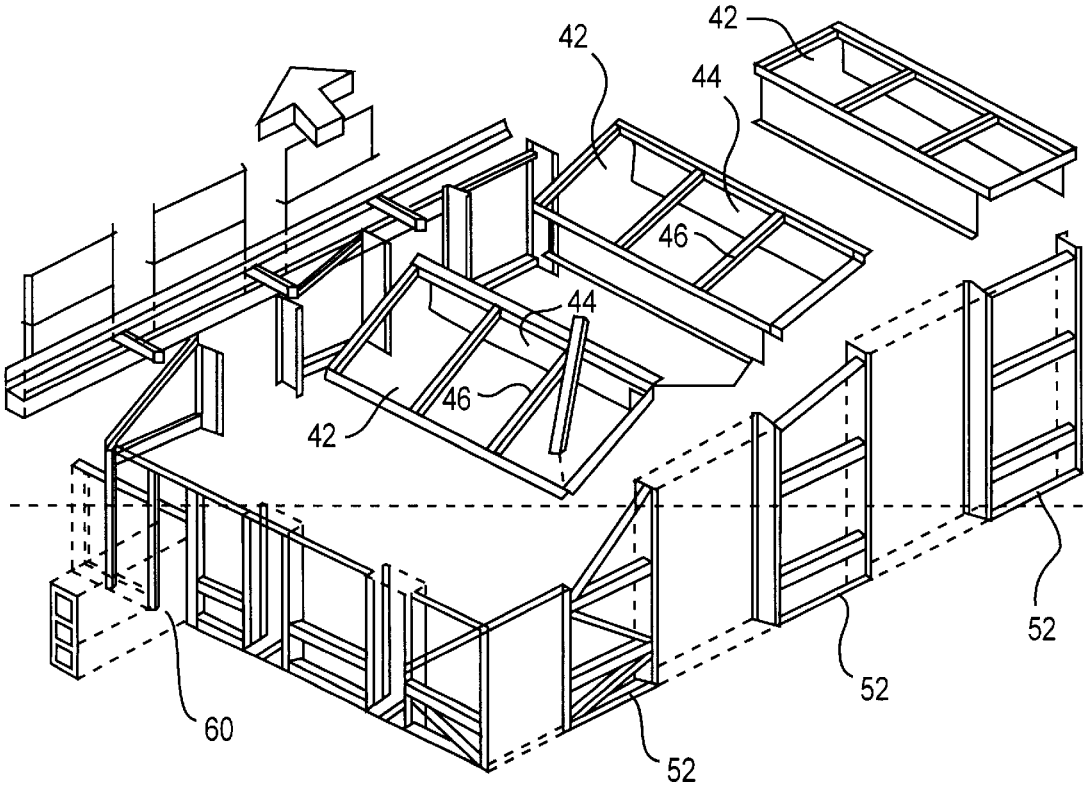
FIG. 8 is a disassembled part view of the embodiment of FIG. 7.

A framed enclosure 30 can be provided in a variety of design styles. FIG. 1 depicts a framed enclosure 30 in a "Mansard" style. FIG. 3 depicts a framed enclosure 30 in a "Hip Gable" style. FIG. 5 depicts a framed enclosure 30 in a "Gable" style. FIG. 7 depicts a framed enclosure 30 in a "Dome" style. In whatever style is selected, the framed enclosure 30 is designed either to stand alone, or to be attachable to a host structure 32, for example a house. The framed enclosure 30 is typically mounted on a foundation 34, e.g., a concrete deck or patio, extending from the host structure 32.

In accordance with the invention, a roof unit includes at least one roof beam. As shown in FIGS. 1–8, a roof 40 of the framed enclosure 30 may be made of one or more modular roof units or sections 42. Each roof unit 42 includes one or more roof beams 44 and supporting purlins 46. The roof beams 44 and purlins 46 may be horizontal or sloped as necessary to define the particular style of roof desired (e.g., Mansard, Gable, Dome, etc.).

In accordance with the invention, a wall unit includes at least one vertical wall column. As shown in FIGS. 1–8, walls 50 of the framed enclosure 30 may be made of one or more modular wall units or sections 52. Each wall unit 52 includes two vertical wall columns 54 and a sill 56. Additional horizontal or diagonal braces 58 may be provided for additional structural strength, particularly at the corners. Furthermore, one or more wall units 52 may be configured with a doorway 60.

In accordance with the invention, a head member is provided between corresponding wall units and roof units. As shown in FIGS. 1–8, each head member 70 preferably includes a lower head member portion 72 and an interlocking upper head member portion 74. The head member 70 of the invention will be described in greater detail below.

In accordance with the invention, the wall column of the wall unit is attachable to a roof beam of a roof unit at a first attachment point. As shown in FIGS. 1–8, wall column 54 and roof beam 44 connect at first attachment point 90, described below.

Figure 21:
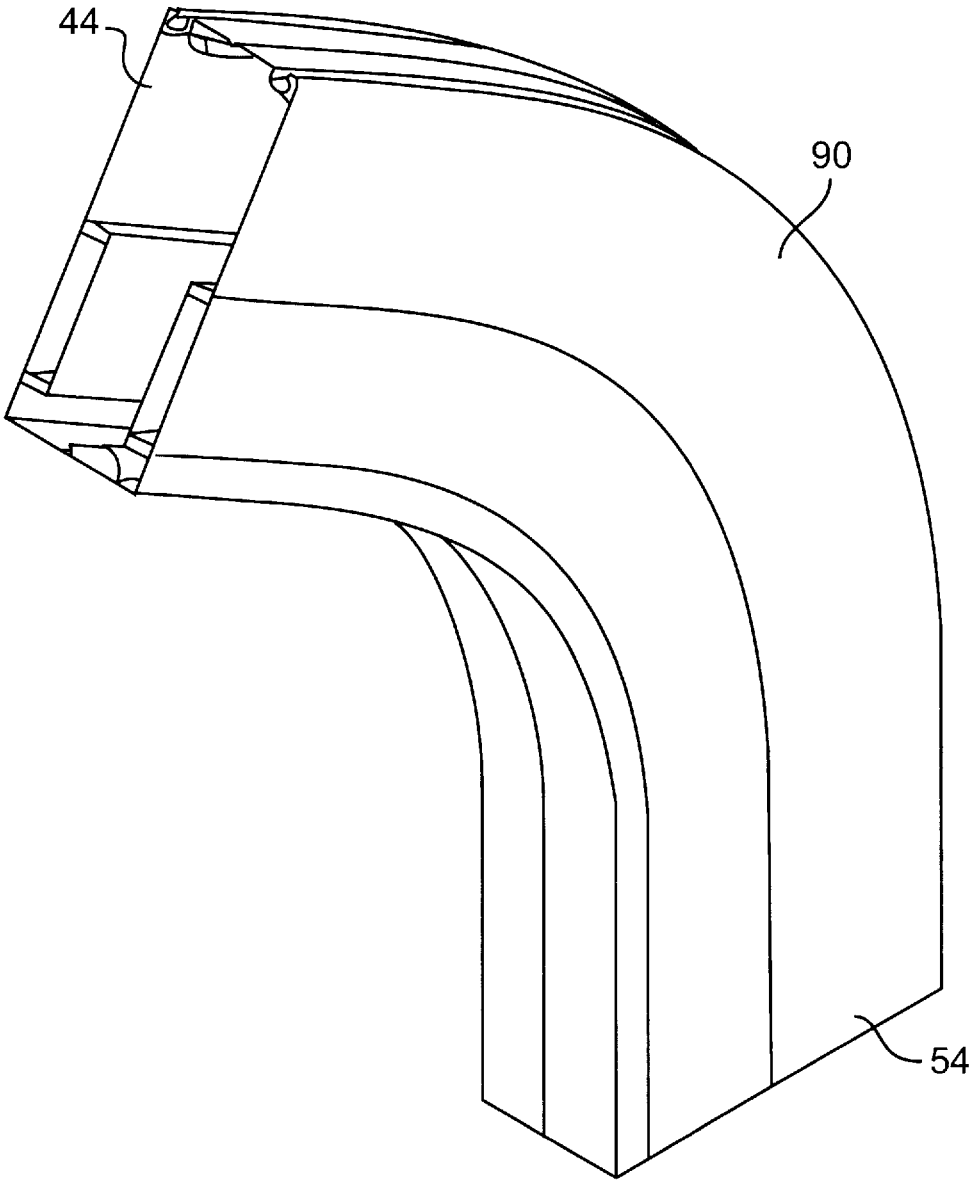
FIG. 21 is a perspective view of a curved integral wall column and roof beam.

In the broadest embodiment, as shown generally in FIG. 1, wall column 54 and roof beam 44 can be configured as one integral beam. The single beam can be bent at first attachment point 90 to define wall beam 54 and roof beam 44 as shown in FIG. 21. Alternatively, wall column 54 and roof beam 44 can be welded or brazed together into an integral unit.

Figure 9:
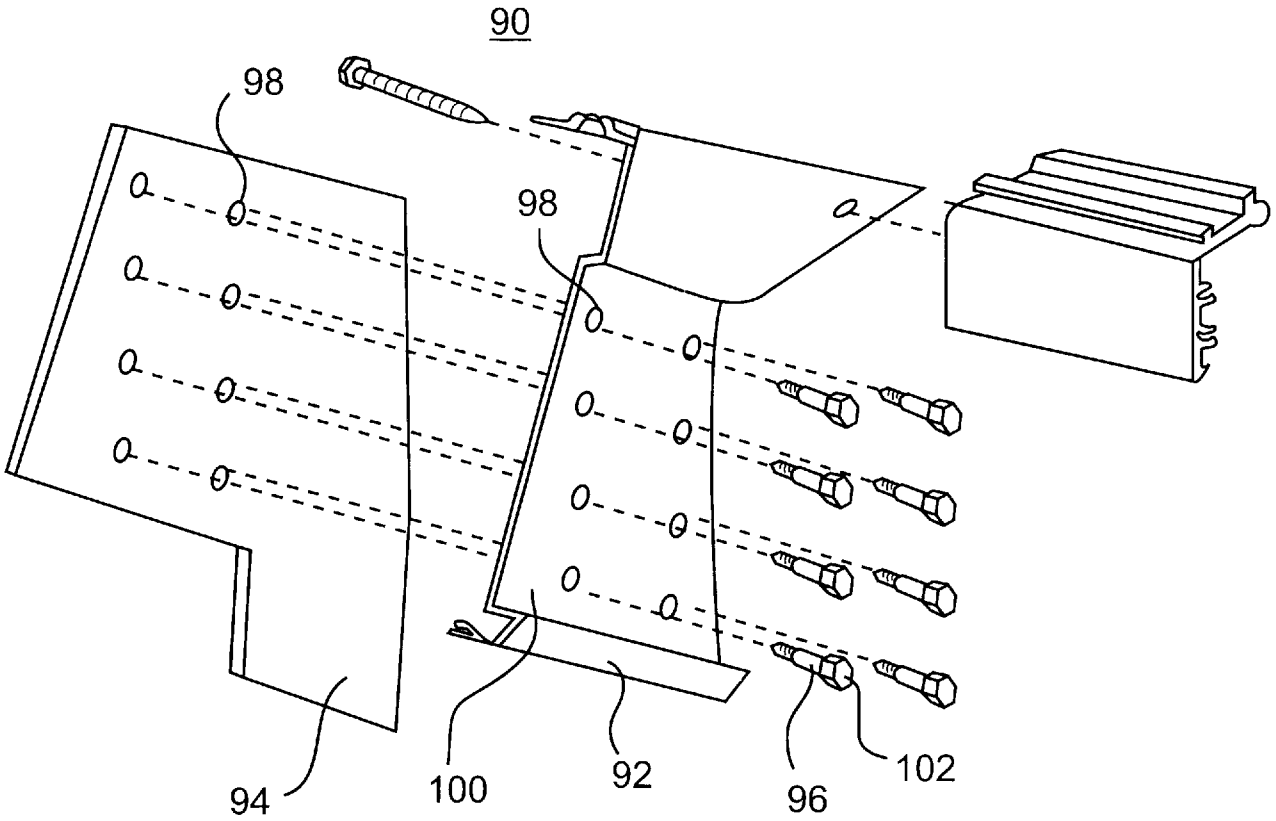
FIG. 9 is a perspective view depicting a first step in the attachment of a roof column to a vertical wall column in accordance with the invention.
Figure 10:
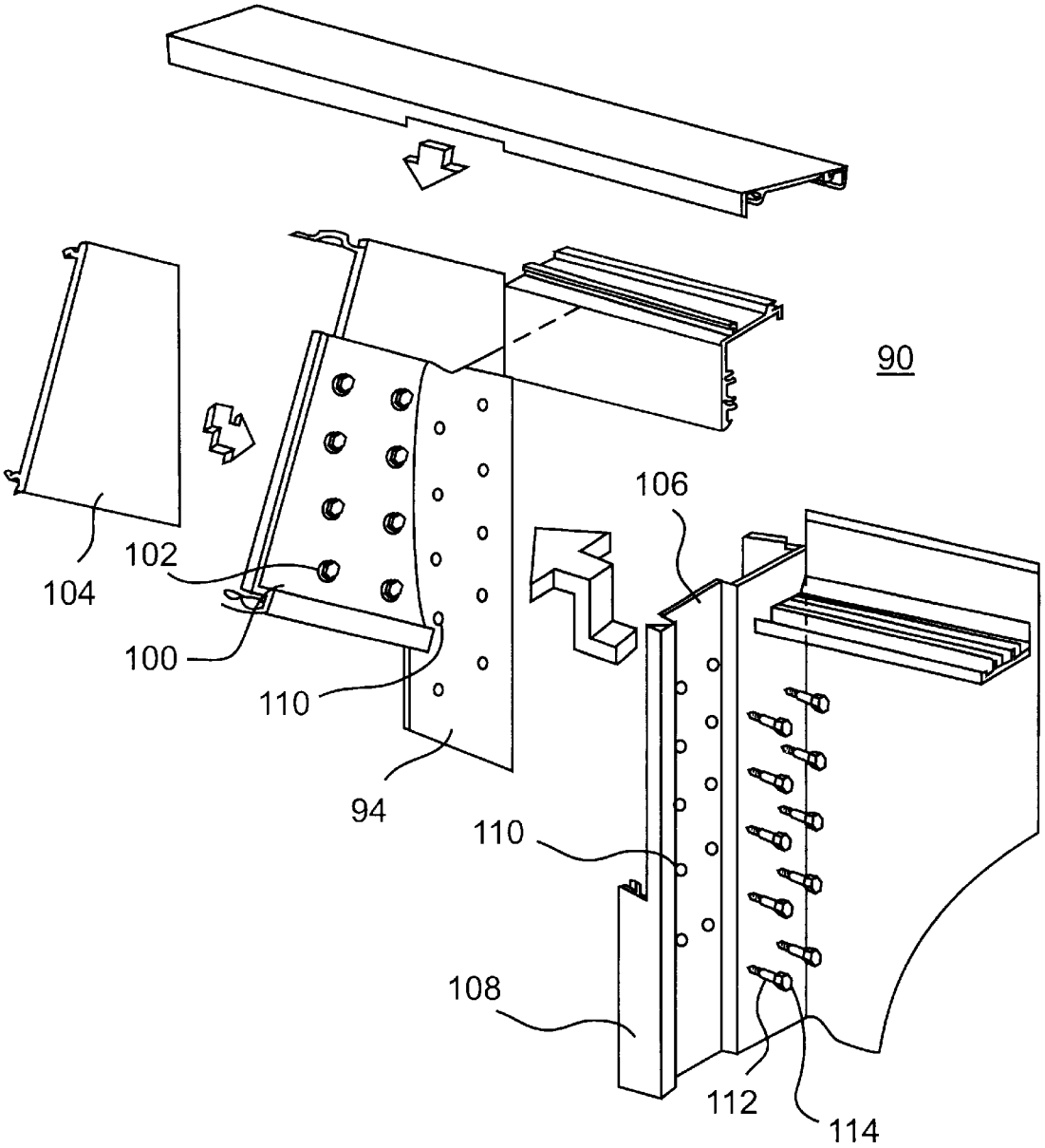
FIG. 10 is a perspective view depicting a second step in the attachment of the roof column to the vertical wall column in accordance with the invention.
Figure 11:
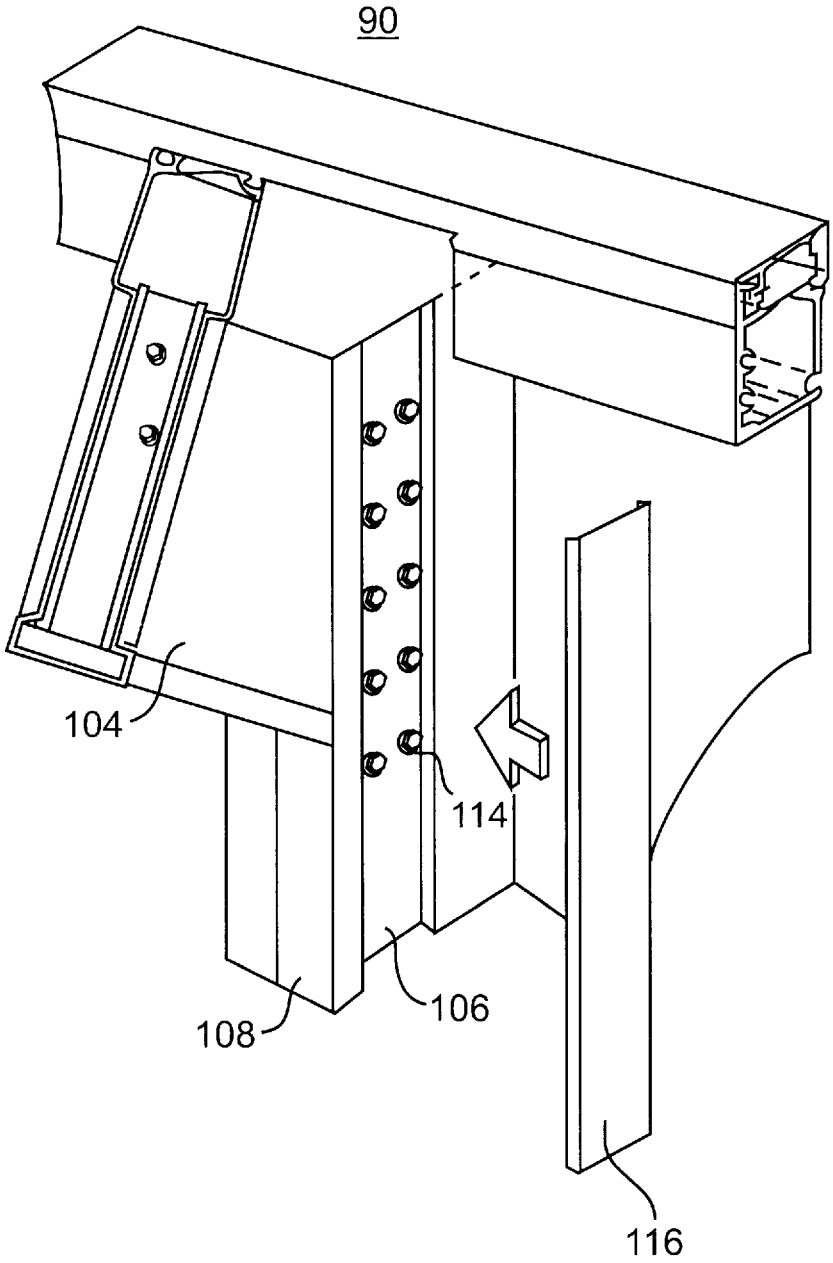
FIG. 11 is a perspective view depicting a third step in the attachment of the roof column to the vertical wall column in accordance with the invention.

Alternatively, wall column 54 and roof beam 44 can be two separate beams. Preferably, as shown in FIGS. 9–11, a gusset plate 94 is connected to a distal end 92 of roof beam 44, by insertion of fasteners 96 through aligned apertures 98 in the gusset plate and roof beam. Distal end 92 of roof beam 44 is formed with a recessed portion 100, and the apertures 98 are provided in the recessed portion 100. Hence as fasteners 96 are inserted into apertures 98, the heads 102 thereof rest in recessed portion 100. A cover plate 104, having the same general shape as recessed portion 100, snaps into place in recessed portion 100, closing the recessed portion 100 and covering heads 102 of fasteners 96.

A recessed portion 106 is also provided in an upper portion 108 of wall column 54. Aligned apertures 110 are provided in recessed portion 106 of wall beam 54 and roof beam 44, and fasteners 112 insert through the aligned apertures 110, with heads 114 thereof resting in recessed portion 106. A cover plate 116, having the same general configuration as recessed portion 106, snaps into place in recessed portion 106, closing the recessed portion 106 and covering heads 114 of fasteners 112.

As described above, first attachment point 90 between wall column 54 and roof column 44 is made with no fasteners, or with the heads of all fasteners used to make the attachment being covered and thereby shielded from the elements.

In accordance with the invention, the wall column of the wall unit is attachable to the foundation at a second attachment point, wherein the second attachment point includes a fastener connecting the wall column to the foundation, and the second attachment point fastener is shielded from the elements. As shown in FIGS. 1–8, wall column 54 connects to foundation 34 at a second attachment point 120, described in detail below.

Figure 12:
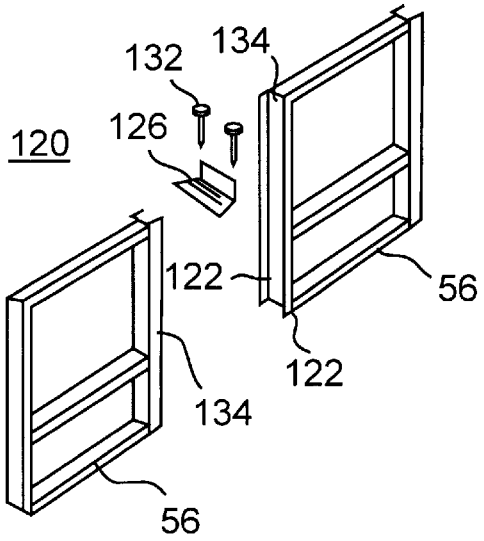
FIG. 12 is a perspective view depicting an intersection of two adjacent wall units in accordance with the invention prior to assembly.
Figure 13:
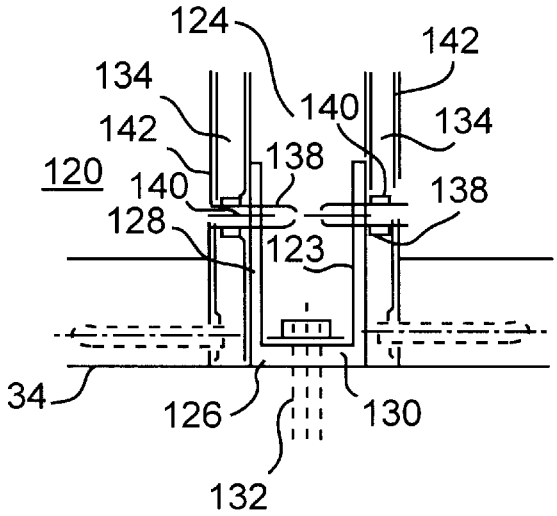
FIG. 13 is a section view depicting an anchor unit provided between two adjacent wall units and a foundation in accordance with the invention.
Figure 14:
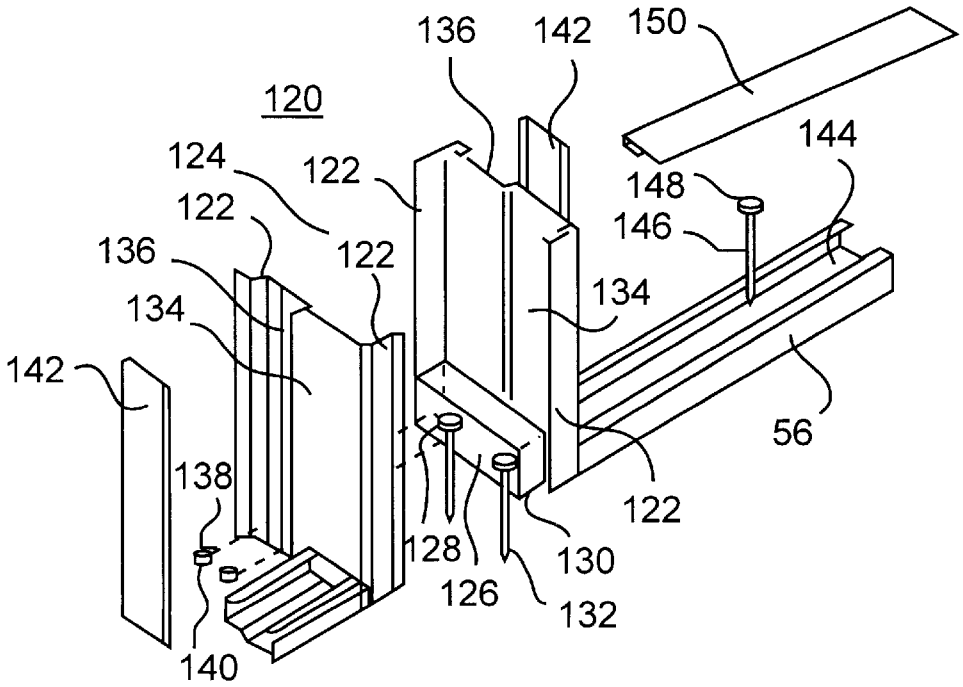
FIG. 14 is a perspective view depicting two partially assembled adjacent wall units in accordance with the invention.

As shown in FIGS. 12–14, each wall column 54 preferably includes a pair of flanges 122 extending from an outer edge thereof, configured to interlock with flanges 122 projecting from vertical column 54 of an adjacent wall unit 50. The interconnection of flanges 122 of adjacent wall columns 54 defines a closed cavity 124 therebetween.

An anchor 126, preferably configured generally in a U-shape with side portions 128 and a bottom portion 130, is provided in cavity 124. Anchor 126 attaches to foundation 34 with one or more fasteners 132 inserted through apertures in bottom portion 130. Anchor 126 attaches to lower portion 134 of each wall column 54 as follows. A recessed portion 136 is defined on the inner surface of lower portion 134 of wall column 54. Fasteners 138 insert through aligned apertures in the recessed portion 136 and side portions 128 of anchor 126, with heads 140 thereof resting in recessed portion 136. A cover 142, having the same general configuration as recessed portion 134, inserts into and closes recessed portion 134, thereby covering heads 140 of fasteners 138.

As described above, second attachment point 120 between wall column 54, adjoining wall column 54, and foundation 34 is made with the heads of all fasteners used to make the attachment being covered and thereby shielded from the elements. Fasteners 132 are shielded by interconnection of flanges 122, and fasteners 138 are shielded by cover 142.

Preferably, another point of attachment of wall unit 52 to the foundation 34 is provided via sill 56. As shown in FIG. 14, a sill recessed portion 144 is provided in sill 56. Fasteners 146 insert through apertures in recessed portion 144 into the foundation 34, with heads 148 thereof resting in sill recessed portion 144. A cover 150 is provided, having the same general configuration as sill recessed portion 144. Cover 150 inserts into and closes recessed portion 144, thereby covering heads 148 of fasteners 146 and shielding them from the elements.

Figure 15:
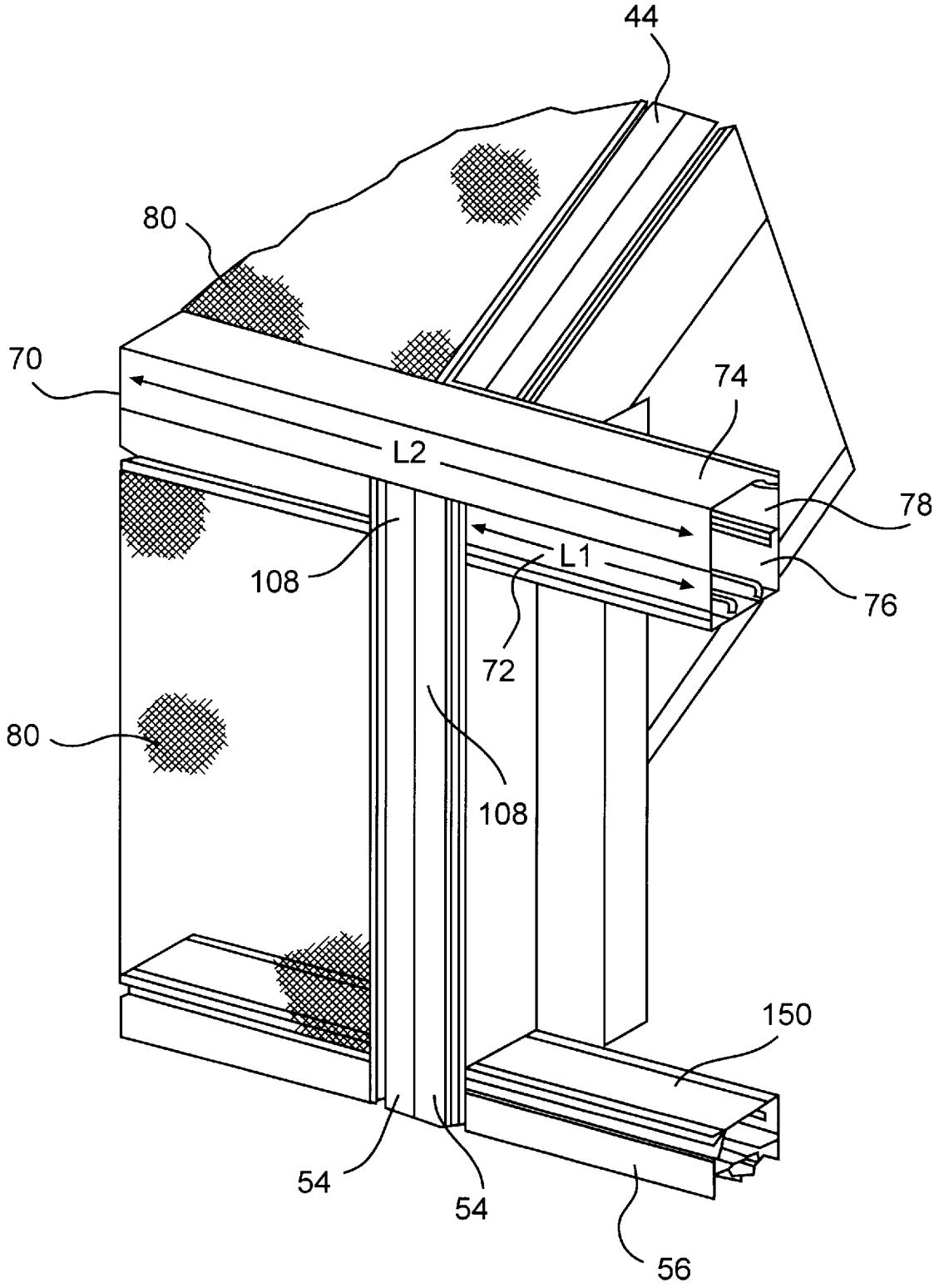
FIG. 15 is a perspective view of a connection between two wall units and a roof unit in accordance with the invention, depicting one embodiment of a head member and insertion of a screen in the wall unit and the roof unit.
Figure 16:
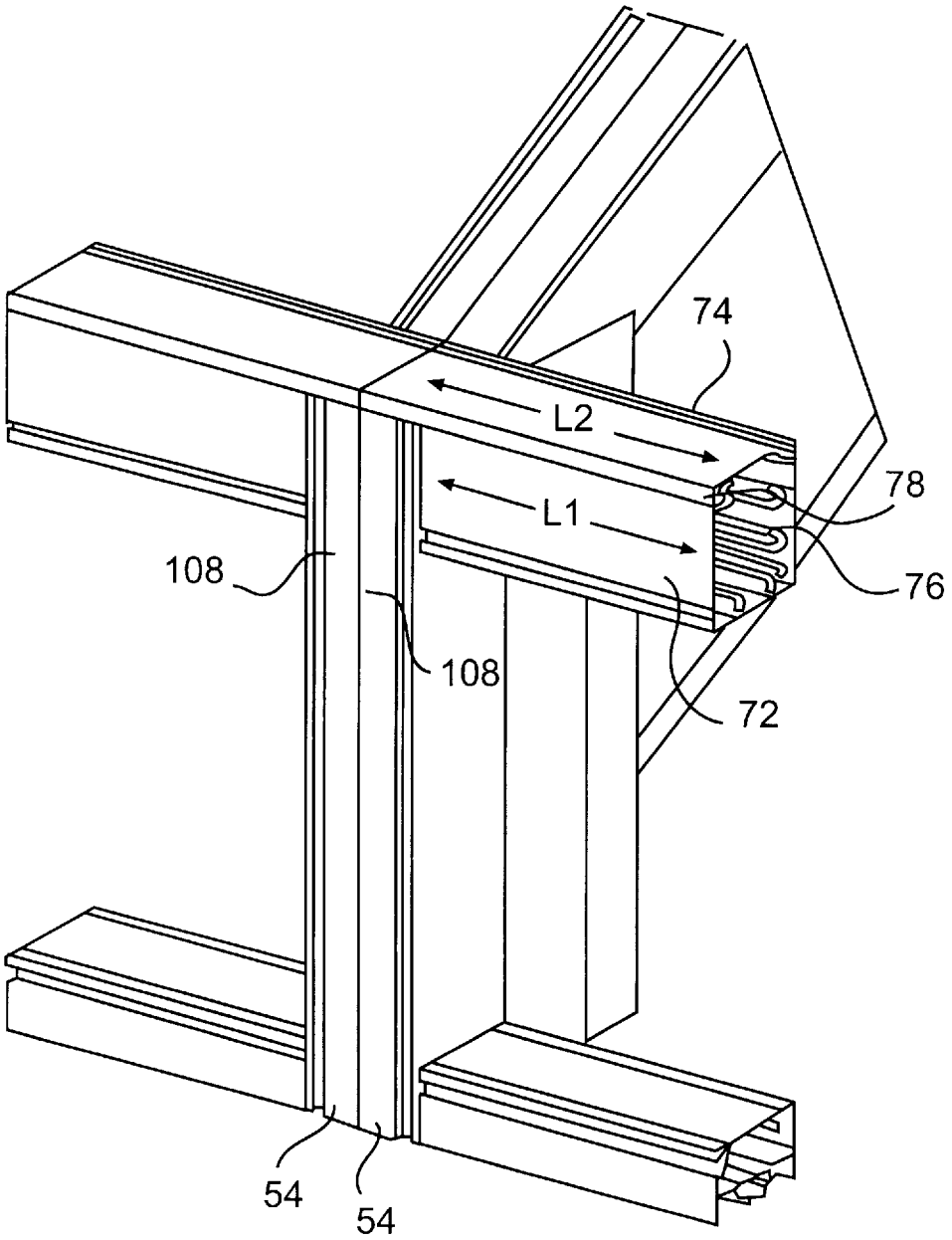
FIG. 16 is a perspective view of a connection between two wall units and a roof unit in accordance with the invention, depicting another embodiment of a head member.

Head member 70 will now be described with reference to FIGS. 15 and 16. As described above, head member 70 includes a lower member 72 and an upper member 74. Each lower member 72 includes an upwardly extending flange 76, and each upper member 74 includes a downwardly extending flange 78. The flanges 76 and 78 interlock, fixing the upper member 74 to the lower member 72. Furthermore, each lower member 72 has a first length L1, conforming generally to the length of the respective wall unit 52 between the two vertical members 54. Each upper member 74 has a length L2 that is greater than L1. As shown in FIGS. 15 and 16, the greater length L2 of upper member 74 allows the upper member 74 to bridge over the upper portion 108 of wall column 54. In this manner, no gap is formed between the head members 70 of adjacent wall units 52.

Preferably, as shown in FIG. 15, a screen portion 80 is attached between the respective wall columns 54 of wall units 52 and between the respective roof beams 44 of roof units 42, to define a framed screened enclosure. However, the invention is not limited to the use of screen material. For example, glass panes could also be provided in the wall units 52 and roof units 42, or a combination of glass panes and screens.

As described above, the framed enclosure 30 can either stand alone, or it can be attached to a host structure 32. Attachment of the framed enclosure 30 to a host structure 32, in accordance with the invention, will be described below with reference to FIGS. 17 and 18.

When configured to attach to a host structure, the framed enclosure of the invention attaches at a third attachment point, wherein the third attachment point includes a gutter attachable to the host structure, and a beam anchor connecting a roof beam to the gutter unit.

Figure 17:
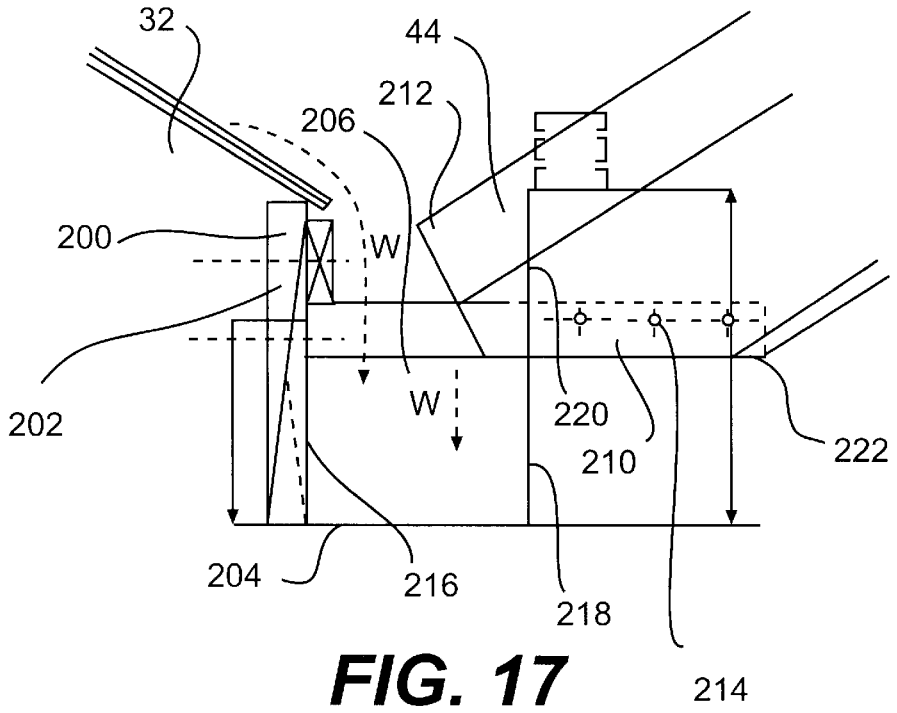
FIG. 17 is a side view depicting attachment of a gutter unit and the roof unit to a host structure in accordance with the invention.
Figure 18:
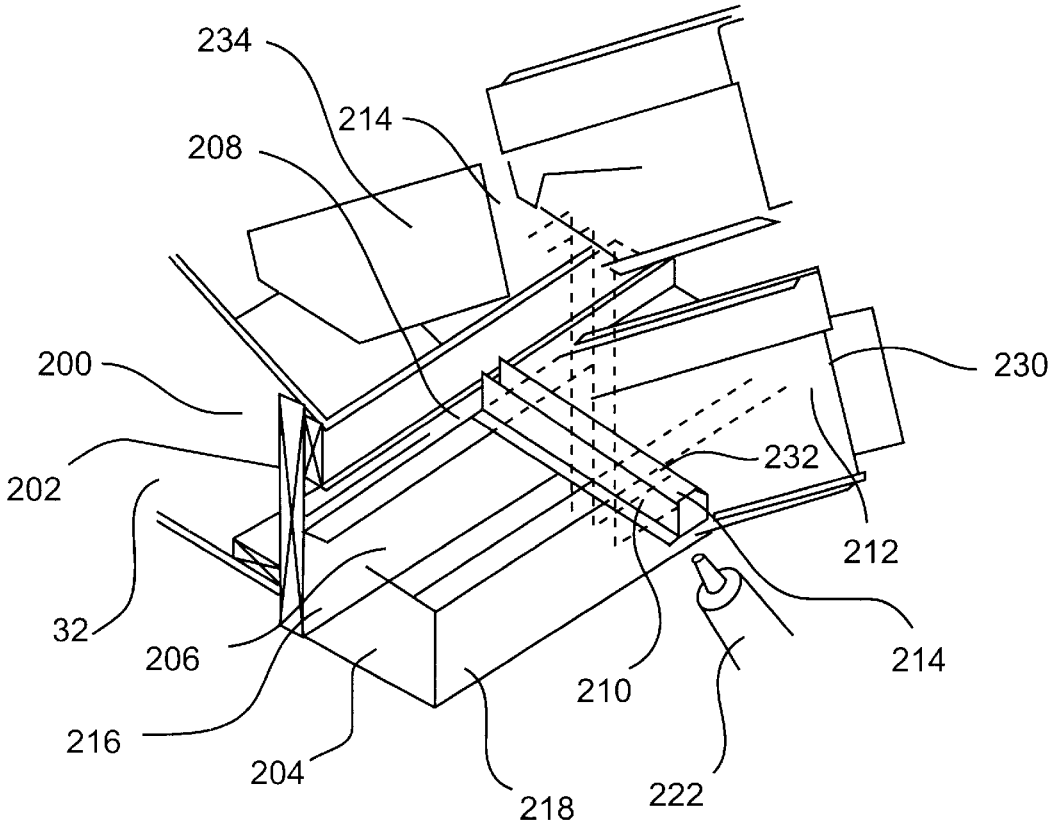
FIG. 18 is a perspective disassembled part view of the gutter unit and the roof unit attached to a host structure in accordance with the invention.

As shown in FIGS. 17 and 18, an eave or roof truss 200, or any other suitable location on host structure 32 is configured with a plate or header 202, which in turn supports a generally U-shaped elongated gutter trough 204, having an upper opening 206. Gutter trough 204 preferably attaches to the header 202 at selected attachment points with conventional fasteners 208.

A plurality of generally U-shaped beam anchors 210 are attached at spaced locations to the gutter trough 204, oriented generally orthogonally to the gutter trough 204, and across the opening 206 of gutter trough 204. These U-shaped beam anchors 210 have a width substantially equal to a width of the roof beams 44 of roof units 42. Each beam anchor 210 is configured to receive a distal end 212 of one roof beam 44. The distal end 212 of such roof beam 44 is attached to the respective beam anchor 210 with conventional metal fasteners 214.

The gutter trough 204 has a first side 216, which lies generally flush with header 202, and a second side 218 which is spaced away from the header 202 and faces the framed enclosure 30. Second side 218 of gutter trough 204 can be provided with a projecting portion 220, which can be attached to an upper edge of second side 218, thereby effectively extending a height of second side 218 so that it is greater than a height of first side 216. This additional height of second side 218, created by attachment of projecting portion 220, acts as a "splash guard". Water rolling off a roof of the host structure 32 (shown by dotted line "W" in FIG. 17) falls into gutter trough 204. If the water rolling off the roof is excessive, it will be prevented from spilling over the second side 218 of gutter trough 204 by the extra height of projecting portion 220. This "splash guard" will direct even excessive water back into opening 206 of gutter trough 204.

As described above, distal ends 212 of the roof beams 44 are inserted into and fastened to the U-shaped beam anchors 210. Typically, a gap is defined between the bottom of the roof beam 44 and a base of the beam anchor 210. It is preferred that a silicon sealant 222 be provided to fill each gap, as shown in FIGS. 17 and 18. The silicon sealant 222, once inserted in the gap, prevents water on the framed enclosure 30 (shown by dotted line W' in FIG. 17) from leaking under the roof beam 44, through the gap between the roof beam 44 and the beam anchor 210, and onto the foundation 34.

In accordance with the invention, each distal end 212 of each roof beam 44 further includes a recessed portion 230 on either side thereof. The fasteners 214 insert through the respective beam anchor 210 and distal ends 212 in the recessed portion 230, with heads 232 thereof resting in recessed portion 230. Covers 234 are provided, having the same general configuration as recessed portion 230. When put in position, the cover 234 encloses the recessed portion 230 and covers the heads 232 of the fasteners 214, thereby shielding the heads 232 of the fasteners 214 from the elements.

Figure 19:
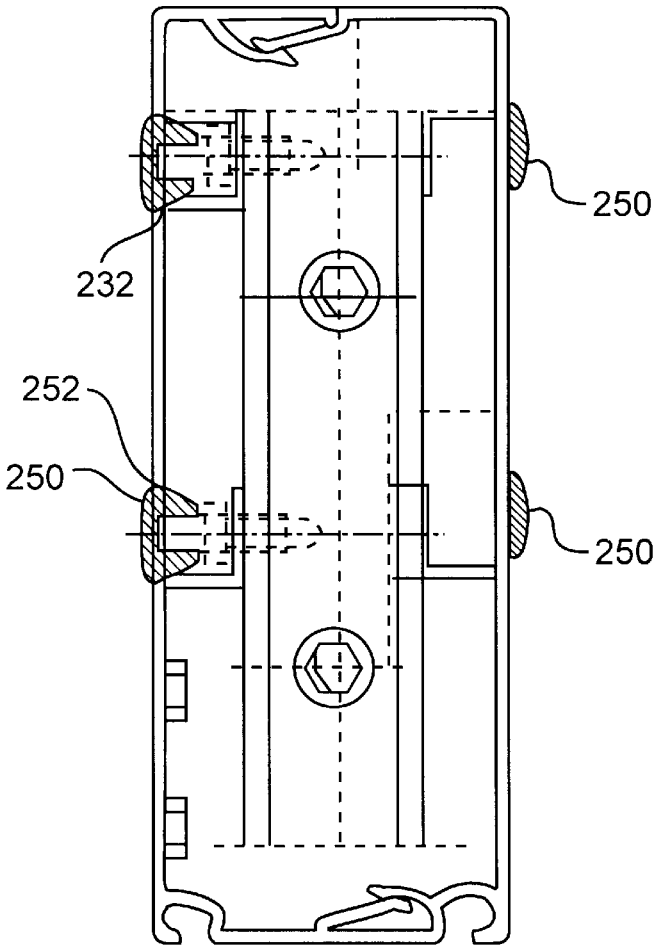
FIG. 19 is a plan view depicting an alternative configuration for covering heads of fasteners in accordance with the invention.
Figure 20:
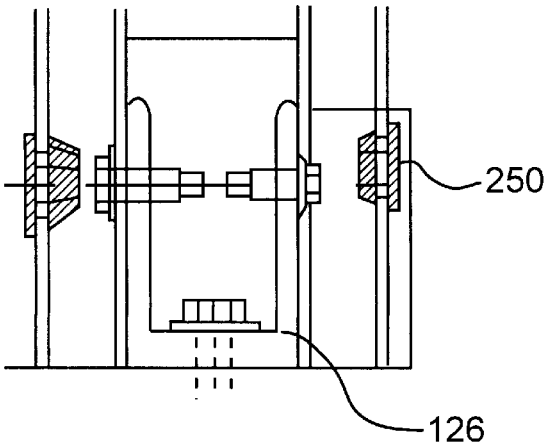
FIG. 20 is a section view depicting the alternative configuration for covering heads of fasteners.

An alternative embodiment to the various covers described above for the first, second, and third attachment points is shown in FIG. 19. In this embodiment, a resilient cap portion 250, molded for example from plastic or rubber, inserts into an aperture 252 provided in each respective wall beam or roof beam. Preferably, the apertures 252 are provided directly over the respective fasteners. In this embodiment, each cap portion 250 can be removed individually in order to adjust the respective fastener, if desired, and then replaced to once again shield the fastener from the elements. Alternatively, although not shown in the drawings, a resilient cap portion 250 can be snapped directly over the head of each individual fastener, thereby shielding the head of each individual fastener from the elements.

The framed enclosure described above enjoys significant advantages over conventional enclosures. The use of recesses and covers at each attachment point between beams of wall units and roof units, between wall units and the foundation, between adjacent wall units, between adjacent roof units, and between roof units and the gutter unit, results in all metal fasteners connecting these various units together being shielded from the elements. Accordingly, the problem of metal fasteners corroding, thereby weakening the enclosure, and the formation of rust stains on the components of the enclosure or on the foundation, is substantially reduced.

The novel configuration of the gutter unit prevents excessive water coming off of the roof of the building structure from splashing over the gutter, and also prevents water coming off the roof of the enclosure from leaking through the connection between the roof unit and the gutter unit. Accordingly, the problem of water stains and mildew on the foundation, and premature weathering of the screen, experienced by conventional enclosures, is minimized.

The novel configuration of the head members prevents the formation of unsightly gaps between head members of adjacent wall units, eliminating the need for an extra piece to plug the gap created in conventional enclosures, and improving the appearance of the enclosure.

Additional advantages and modifications will readily occur to those skilled in the art. The invention in its broader aspects is, therefore, not limited to the specific details of the preferred embodiments described above. Departures may be made from such details without departing from the spirit or scope of the invention. The scope of the invention is established by the attached claims and their equivalents.

What is claimed is:

1. A framed enclosure configured to be attachable to a foundation comprising:

a roof unit including at least one roof beam;

a wall unit including at least one vertical wall column;

a first attachment point attaching said wall column to said roof beam, said first attachment point including a recess provided in an upper portion of said wall column, a first fastener attaching said wall column to said roof beam, a head of said first fastener provided in said recess, and a cover inserting into and closing said recess; and a second attachment point attached to a lower end of said wall column for attaching said wall column to the foundation;

wherein said second attachment point includes a second fastener for connecting said wall column to the foundation and a cover shielding said second fastener from external elements.

2. The enclosure of claim 1, wherein said roof beam and said wall column comprise a single unit.

3. The enclosure of claim 2, wherein said wall column is curved at said first attachment point to define said roof beam.

4. The enclosure of claim 1, wherein said first attachment point further includes a gusset plate connected to a distal end of said roof beam with a gusset plate fastener, and a cover covering the gusset plate fastener.

5. The enclosure of claim 1, wherein said second attachment point includes an anchor attached to a lower portion of said wall column and attachable to the foundation.

6. The enclosure of claim 5, wherein the second attachment point includes a flange extending from an edge of said wall column, capable of engaging a vertical wall column of an adjacent wall unit, and defining a cavity therebetween enclosing the anchor and shielding said second fastener.

7. The enclosure of claim 5, wherein the anchor attaches to said wall column with a third fastener having a head thereof provided in a recess in a lower portion of said wall column, and a cover inserts into and closes the recess in the lower portion of said wall column.

8. The enclosure of claim 1, wherein said wall unit further comprises a sill, the sill being attachable to the foundation.

9. The enclosure of claim 8, wherein the sill includes a sill recess, a fourth fastener for connecting the sill to the foundation with a head thereof provided in the sill recess, and a sill cover covering the sill recess.

10. The enclosure of claim 2, wherein the enclosure further comprises a third attachment point attached to said roof beam for attaching the enclosure to a host structure.

11. The enclosure of claim 10, wherein said third attachment point includes a gutter unit attachable to the host structure, and a beam anchor connecting said roof beam to said gutter unit.

12. The enclosure of claim 12, wherein said third attachment point further includes a fifth fastener attaching said roof beam to the beam anchor, and a roof beam cover covering the fifth fastener.

13. The enclosure of claim 13, wherein said third attachment point further includes a recess provided in said roof beam, the head of the fastener is provided in said fifth recess, and the roof beam cover inserts into and closes the recess in said roof beam.

14. The enclosure of claim 12, wherein said gutter unit includes a splash guard for preventing water from the host structure spilling out of said gutter unit.

15. The enclosure of claim 12, further including a sealant provided in the connection between the beam anchor and said roof beam.

16. The enclosure of claim 1, further comprising a head member provided between said roof unit and said wall unit.

17. The enclosure of claim 17, wherein said head member includes a lower portion having a first length, and an upper portion interconnected with said lower portion and having a second length greater than the first length.

18. The enclosure of claim 1, further comprising a screen portion attachable to at least one of said roof unit and said wall unit.

19. The enclosure of claim 1, further including a cap member covering the head of said first fastener.

20. A wall unit configured to be attachable to a roof unit, an adjacent wall unit, and a foundation external to a building structure, to define a framed enclosure, the wall unit comprising:

a vertical wall column;

a first attachment point provided in an upper portion of said wall column for attaching the wall unit to the roof unit, said first attachment point including a recess provided in an upper portion of said wall column, a first fastener for attaching said wall column to the roof unit, a head of said first fastener projecting into said recess when said wall column is attached to the roof unit, and a cover closing the recess and covering the head of said first fastener;

a second attachment point for connecting said wall column to the foundation, said second attachment point including a second fastener, and a cover shielding a head of said second fastener from external elements; and a head member attached to the wall unit between the wall unit and the roof unit.

21. The wall unit of claim 21, wherein said second attachment point includes an anchor attached to a lower portion of said wall column and attachable to the foundation.

22. The wall unit of claim 23, wherein said second attachment point includes a flange extending from an edge of said wall column, capable of engaging a vertical column of the adjacent wall unit and defining a cavity therebetween enclosing the anchor and shielding said second fastener.

23. The wall unit of claim 23, wherein the anchor attaches to said wall column with a head of a third fastener provided in a recess in the lower portion of said wall column, and a cover inserts into and closes the recess in the lower portion of said wall column.

24. The wall unit of claim 20, wherein said head member includes an upper member interconnected with a lower member.

25. The wall unit of claim 24, wherein said lower member has a first length and said upper member has a second length greater than the first length.

26. The wall unit of claim 20, further comprising a sill connected to said vertical wall column and attachable to the foundation.

27. The wall unit of claim 26, wherein said sill includes a sill recess, a fourth fastener for connecting said sill to the foundation with a head of the fourth fastener provided in the sill recess, and a sill cover closing the sill recess.

28. The wall unit of claim 20, further comprising a screen portion attached to at least one of said wall column and said head member.

29. The wall unit of claim 20, wherein said covers include cap members covering the heads of said first fastener.

30. A roof unit configured to be attachable to a plurality of wall units to define a framed enclosure, comprising:

a roof beam including a first attachment point, attachable to a vertical column of one of the wall units at said first attachment point; and a purlin supporting the roof beam;

wherein said first attachment point includes a recess provided in a distal end of said roof beam, a first fastener for fixing the roof beam to the vertical column, with a head of said first fastener projecting into said recess when said roof beam is fixed to the vertical column, and a cover closing the recess and covering said head of said first fastener to shield the head from external elements.

31. The roof unit of claim 30, wherein the roof unit is further attachable to a host structure via a gutter unit at a second attachment point.

32. The roof unit of claim 31, wherein the second attachment point includes a beam anchor fixed to a distal end of the roof beam with a second fastener, a head of said second fastener provided in a recess defined proximate the distal end of the roof beam, and a cover closing the recess and covering the head of said second fastener.

33. The roof unit of claim 32, further comprising a sealant inserted between the distal end of the roof beam and the beam anchor.

34. The roof unit of claim 30, further comprising a screen portion attached to said roof beam.

* * * * *

UNITED STATES PATENT AND TRADEMARK OFFICE

CERTIFICATE OF CORRECTION

PATENT NO. : 5,832,683
DATED : November 10, 1998
INVENTOR(S) : ITO et al.

It is certified that error appears in the above-identified patent and that said Letters Patent is hereby corrected as shown below:

Claim 12, column 8, line 38, "claim 12" should read --claim 11--.

Claim 13, column 8, line 42, "claim 13" should read --claim 12--.

Claim 13, column 8, line 44, before "fastener", "the" should read --said fifth--; and before "recess", "said fifth" should read --the--.

UNITED STATES PATENT AND TRADEMARK OFFICE

CERTIFICATE OF CORRECTION

PATENT NO. : 5,832,683
DATED : November 10, 1998
INVENTOR(S) : ITO et al.

It is certified that error appears in the above-identified patent and that said Letters Patent is hereby corrected as shown below:

Claim 14, column 8, line 47, "claim 12", should read --claim 11--.

Claim 15, column 8, line 50, "claim 12", should read --claim 11--.

Claim 17, column 8, line 55, "claim 17", should read --claim 16--.

Claim 21, column 9, line 18, "claim 21", should read --claim 20--.

Claim 22, column 9, line 21, "claim 23", should read --claim 21--.

Claim 23, column 9, line 26, "claim 23", should read --claim 21--.

Signed and Sealed this

Fifteenth Day of June, 1999

*Attest:*

Q. TODD DICKINSON

*Attesting Officer*

*Acting Commissioner of Patents and Trademarks*